US005565295A

United States Patent [19]

Tavernier et al.

[11] Patent Number: 5,565,295

[45] Date of Patent: Oct. 15, 1996

[54] ELECTROPHOTOGRAPHIC DEVELOPER COMPOSITION

[75] Inventors: Serge M. Tavernier, Lint; Werner J. Op de Beeck, Keerbergen; Robert F. Janssens, Geel; Paul J. Coppens, Turnhout, all of Belgium

[73] Assignee: AGFA-Gevaert, N.V., Mortsel, Belgium

[21] Appl. No.: 405,394

[22] Filed: Mar. 15, 1995

Related U.S. Application Data

[63] Continuation of Ser. No. 129,207, filed as PCT/EP92/00773 filed Apr. 3, 1992 published as WO92/18908 filed Oct. 29, 1992, abandoned.

[30] Foreign Application Priority Data

Apr. 11, 1991 [EP] European Pat. Off. ..... 91200848

[51] Int. Cl.[6] ..... G03G 13/08

[52] U.S. Cl. ..... 430/126; 430/111

[58] Field of Search ..... 430/111, 126, 430/101, 122, 110

[56] References Cited

U.S. PATENT DOCUMENTS

| | | | |
|---|---|---|---|
| 4,555,467 | 11/1985 | Hasegawa et al. | 430/111 |
| 4,582,774 | 4/1986 | Landa | 430/126 |
| 4,626,868 | 12/1986 | Tsai | 430/46 |
| 4,678,734 | 7/1987 | Laing et al. | 430/137 |

FOREIGN PATENT DOCUMENTS

| | | | |
|---|---|---|---|
| 2723688 | 12/1977 | Germany | 430/111 |
| 59-102252 | 6/1984 | Japan | 430/111 |

OTHER PUBLICATIONS

*Xerox Dislosure Journal*, vol. 2, No. 5, Toner Mixture for Improved Image Quality, Goel et al., 1977.

Patent Abstracts of Japan, vol. 9, No. 90(P–350) (1813) (JP–A–59–218457), 1985.

WO/91/00548, Jan. 1991.

Xerox Disclosure Journal, vol. 2, No. 5, Toner Mixture to Reduce Background Trans for Effects, S. Pond, 1977.

*Primary Examiner*—Christopher D. Rodee

*Attorney, Agent, or Firm*—Breiner & Breiner

[57] ABSTRACT

A dry developer composition suitable for use in the development of an electrostatic charge pattern is described. This developer composition comprises toner particles the average particle diameter whereof is comprised between 3 and 10 microns, and spacing particles the average diameter whereof is under 40 microns and at least twice the average particle diameter of the toner particles, and is characterized in that the part of spacing particles in the overall amount of spacing particles and toner particles is comprised between 1 and 8% by weight.

6 Claims, No Drawings

ELECTROPHOTOGRAPHIC DEVELOPER COMPOSITION

This is a continuation of application Ser. No. 08/129,207, filed as PCT/EP92/00773 filed Apr. 3, 1992 published as WO92/18908 filed Oct. 29, 1992, now abandoned.

FIELD OF THE INVENTION

The present invention relates to a dry developer composition suitable for use in the development of an electrostatic charge pattern, comprising spacing particles on the one hand, and classified fine toner particles on the other hand.

BACKGROUND PRIOR ART

It is well known in the art, of electrographic, electrostatographic and electrophotographic copying and printing to form an electrostatic latent image corresponding either to the original to be copied, or to the digitized data describing an electronically available image, on a photoconductive member. In another image forming method, the electrostatic latent image is formed by imagewise discharge over styli towards a dielectric substratum. Another image forming method is called the xeroprinting process such as disclosed e.g. in European Patent Application 0 243 934 and it involves imagewise exposing a photopolymer master, charging e.g. by corona, toning with dry or liquid toner and transferring to another substrate. A survey of different methods for the production of electrostatic images on photoconductive electrically insulating recording materials and on non-photoconductive electrically insulating recording materials is given e.g. in U.S. Pat. No. 4,130,670.

Electrostatic latent images can be developed using a liquid developer consisting of a colloidal system of charged colloidal particles in an insulating liquid. In most cases the latent image is developed with a finely divided developing material or toner to form a powder image which is then transferred onto a support sheet such as paper. The support sheet bearing the toner powder image is subsequently passed through a fusing apparatus and is thereafter discharged out of the copying resp. printing machine as a final copy, resp. final print.

One of the objectives set forth for the overall electrostatographic process is to provide an image on the final copy, resp. final print with the best possible quality.

By 'quality' in electrostatography is generally understood a true, faithful reproduction of the original to be copied, or faithful visual print of the electronically available image.

Quality consequently comprises features such as uniform darkness of the image areas, background quality, clear delineation of lines, as well as overall resolution of the image. The accuracy, inclusive of the resolution, with which the latent electrostatographic image, formed in either an electronic printing or copying apparatus, is developed into a visually discernable copy, is predominantly determined by the characteristics of the developer used.

It is known that one of the principal contributing characteristics herefore is the size and size distribution of the developer particles used, and in case a two component developer material is used, in particular the size and size distribution of the toner particles employed.

In the document published by ATR Corporation, 6256 Pleasant Valley Road, El Dorado, Calif. 95623, entitled 'Effect of Toner Shape on Image Quality' published Mar. 28, 1988, the influence of toner particle diameter and shape upon image quality, particularly for high resolution images, has been tested.

For a developer to be used in a high resolution laser beam printer, the effects of toner particle size and shape upon the image were experimentally examined. As a result it was made clear that apart from the shape of the toner and its charge distribution, fine particles are most effective to provide high resolution.

This fact being known in itself, there have been several prior art proposals for the manufacture of fine toner particles and in particular for toner particles, the size distribution of which meets a well-defined classification.

In U.S. Pat. Nos. 3,942,979, 4,284,701, GB 2,180,948, EP-A 0 255 716 and in particular in EP-A-89201695.7 now publication number 479,875 such classified fine developers have been described.

One of the problems encountered with such fine developers, is the reduced efficiency of transferring the fine toner-image layer from the photoconductive surface to the image receiving substrate.

Such problem is e.g. explicitely recognised in EP-A-354 531 wherein is stated that the conventional electrophotographic process works well with large toner particles, but that difficulties arise as the size of the toner particles is reduced. Image defects such as "halo defect", "hollow character" and "dot explosion" arise. Thus, high resolution images require very small particles, but high resolution images without image defects have not been achievable using electrostatically assisted transfer.

In experiments it also has been noticed that when toner images present on the photoconductive drum are transferred in a conventional electrophotographic transfer station, the transfer efficiency decreases substantially when fine toner particles are used, as is required for obtaining high resolution images.

Whether the toner particles are prepared by conventional techniques, or by any alternative preparation method, as direct suspension polymerization techniques, spray drying, heterocoagulation, etc. the criticality in transfer behaviour described above does not alter.

In "Xerox Disclosure Journal" vol. 2, no. 5, September/October 1977, page 13 "Toner mixture for improved image quality" it is disclosed that a high transfer efficiency may be obtained when a bi-modal toner particle size distribution is employed. A preferred mixture of toner comprises particles of about 10–15 microns diameter and particles of about 4 microns or less. However, said disclosure contains no indication as to the respective amounts of smaller and larger toner particles which should be used for obtaining a high transfer efficiency. From experiments we have learned, as will be described hereinafter, that surprisingly, a high transfer efficiency and consequently a high image quality can only be obtained when particular ratios or amounts of smaller resp. larger particles are used.

OBJECT OF THE INVENTION

It is therefore an object of the present invention to provide a dry developer composition suitable for use in the development of an electrostatic charge pattern generated in e.g. an electrophotographic process comprising transfer of a toner image layer from an image bearing member such as e.g. a photoconductive drum to a substrate thereby yielding high image quality, in particular high image resolution without noticeable image defects.

It is a further object of the present invention to provide a dry developer composition suitable for use in an electrophotographic process comprising electrostatically assisted transfer of the toner image layer from an image bearing member to a substrate, whereby the above-described image deficiencies do not occur.

Further objects will become apparent from the description hereinafter.

SUMMARY OF THE INVENTION

We now have found that the above objects can be met by the use of a dry developer composition suitable for use in the development of an electrostatic charge pattern, said composition comprising toner particles the average particle diameter whereof is comprised between 3 and 10 microns and spacing particles the average particle diameter whereof is at most 40 microns and at least twice the average particle diameter of the toner particles, and characterised in that the part of spacing particles in the overall amount of spacing particles and toner particles is comprised between 1 and 8 percent by weight, and more preferably between 2 and 5 percent by weight.

According to a preferred embodiment of our invention said dry developer composition comprises toner particles, the average particle diameter whereof is comprised between 3 and 6 micron, and spacing particles, the average particle diameter whereof is comprised between 10 and 20 micron.

According to a further preferred embodiment, the toner and spacing particles have an identical chemical composition, only their size distribution is different. This means that the spacing particles themselves act as toning particles and the overall dry developer composition is actually characterised by a bimodal particle size distribution of the toner.

Further preferred embodiments will become apparent from the description hereinafter.

DETAILED DESCRIPTION OF THE INVENTION

Spacing particles in the overall developer composition.

We have found that, when spacing particles are incorporated into the developer composition under the conditions as described hereinafter, the efficiency of transferring the toner image from the image bearing member to the substrate surprisingly increased noticeably, and the problems described above such as hollow character et al did not occur.

As will be described in detail hereinafter, the term 'average particle diameter' is defined as the square root of the product of the average particle diameter by volume times the average particle diameter by number.

The spacing particles can only exert a 'spacing function' as defined hereinafter, if said spacing particles have an average particle diameter at least twice the average particle diameter of the toner particles. Further, the spacing particles should have a particle diameter not exceeding 40 micron. Spacing particles having a particle diameter larger than 40 micron give rise to problems such as transfer deficiency due to an airgap between the image bearing member and the transfer roller being too large, resulting in too low an electrical transfer field. Moreover, when the diameter of the spacing particles comes close to 40 micron, onset on quality degradation occurs.

For obtaining high resolution images on the substrates, the toner particles used in the developer composition of our invention are characterised by a low average particle diameter; their average particle diameter should be situated between 3 and 10 micron, and more preferably between 3 and 6 micron.

The spacing particles further preferably are characterised by a narrow particle size distribution: their average particle diameter should preferably be comprised between 10 and 20 micron. They can be made from the same base material and according to the same preparation methods as the toner particles. Conventional toner preparation methods, as well as alternative methods such as e.g. spray drying; polymerisation techniques; heterocoagulation, etc. . . . can be considered. When toner particles are made by one method; the spacing particles can be made by the same or any other method. In a preferred embodiment the toner and spacing particles have an identical chemical composition and they are prepared using the same techniques. However, the spacing particles composition may also be different from the toner particles in respect of the colorant, charging agent etc. selected. Hereinafter the preparation of conventionnally prepared toner particles is described. Like the toner particles, the spacing particles are made of a base resin and further may comprise various additives such as charge control agents, flow enhancing additives, and in case a magnetic monocomponent toner is used, a magnetizable pigment.

In case a colorant is incorporated into the spacing particles—preferably the same colorant as is used for the preparation of the toner particles—then the spacing particles themselves also act as 'toning' particles. The use of spacing particles along with finer classified toner particles then results actually in using an overall toner composition the size distribution whereof obtains a so-called bimodal particle distribution. The smaller-size toner particles in said bimodal particle distribution correspond to the actual finer-size toner particle size distribution and the larger-size spacing particles in said bimodal particle distribution correspond to the spacing particle size distribution.

According to this embodiment, the present invention provides a dry developer composition featuring a bimodal toner particle size distribution comprising on the one hand finer and on the other hand larger toner particles; in said distribution the finer particles have an average particle diameter comprised between 3 and 10 micron, and according to a more preferred embodiment, between 3 and 6 micron, and the larger particles have an average particle diameter below 40 micron and an average particle diameter at least twice the average particle diameter of the finer particles. According to a preferred embodiment, the average particle diameter of the larger particles is comprised between 10 and 20 micron. The weight proportion between finer toner particles to larger spacing particles in the overall developer composition of our invention is preferably as follows:

the larger spacing particles may vary between 1 and 8%, more preferably between 2 and 5%, of the overall weight of the developer composition (excluding the weight of the carrier particles in case a two-component developer composition is used); this implies that the finer toner particles vary between 99 and 92%, more preferably between 98 and 95% of the overall developer composition.

According to the embodiment of our invention wherein a developer characterised by a bimodal toner particle distribution is employed, said developer is prepared by mixing separately prepared finer toner particles and larger spacing particles; the average particle diameter of the finer toner particles and of the larger spacing particles can then be measured before mixing both particles so as to obtain the bimodal particle size distribution.

We have found that the beneficial advantages of using spacing particles in the developer composition of our invention on the transfer efficiency of e.g. an electrophotographic transfer process are not limited to the use of a particular toner receiving substrate. As toner receiving substrates can be mentioned: plain paper, paper type 'couche' of 80, 120 or 200 gr/m2 such as supplied by e.g. Arjomari S. A., Impasse Reille 1, 75014 Paris, polyethylene coated paper, phototypesetting film or paper, transparent polymeric film made e.g. of polyethylene terephthalate such as the film marketed under the trade name 'Transparex' by Agfa-Gevaert N. V., Belgium, as well as lithographic printing plate precursors comprising a crosslinked hydrophilic layer on a plastic film support such as described e.g. in EP-A-8920/696. The above-mentioned beneficial effects on transfer efficiency, and hence high fidelity of the original to be reproduced, are equally well noted when using any of these toner receiving substrates.

Image forming process

The basic image forming process such as e.g. an electrophotographic process wherein the developer composition of the present invention is used comprising steps such as (imagewise) charging, (imagewise) discharging, developing, transferring, fixing and the subsequent cleaning of the image bearing member is carried out according to techniques known in the art, as described, for example, in "Electrophotography" written by R. M. Schaffert and published by The Focal Press, London, Enlarged and Revised Edition, 1975.

Since the practice of electrophotography is well known to those skilled in the art, the various processing stations of an electrophotographic apparatus will not be described in detail. An electrophotographic apparatus wherein the developer composition according to our invention can be used is described e.g. in EP-A-0131070.

Development of the latent image

Development of an electrostatic charge pattern commonly occurs with toner particles that are attracted by coulomb force to the charge pattern carried by the latent image recording surface. In positive—positive development toner particles deposit on those areas of the charge carrying surface which are in positive—positive relation to the original image to be developed. In reversal development, toner particles migrate and deposit on recording surface areas which are in positive-negative relation to the original image. In such case in the initially non-charged or decharged areas by induction through a properly biased developing electrode opposite charges to the toner charge are produced and toner is deposited in said areas. (ref.: R. M. Schaffert "Electrophotography"—The Focal Press—London New York, Enlarged and Revised Edition 1975, pp, 50–51, and T. P. Maclean "Electronic Imaging" Academic Press—London, 1979, p. 231).

The toner particles are normally triboelectrically charged in contact with another material usually in the form of carrier particles which material in the triboelectric series stands sufficient away from the material of the toner. A triboelectric series serving as a guidance in the production of toner material is given in the periodical "Physics Today"/May 1986, p. 51.

On a microscopic scale, the sign and magnitude of the toner charge is determined by the triboelectric relationship between the toner and the carrier-particle surface composition. The mechanical agitation occurring in preparing that mixture and during the development process ensures the necessary charging of the toner particles.

A survey of different techniques used in the development of electrostatic charge patterns is given in IEEE Transactions on Electron Devices, Vol. ED-19, No. 4, April 1972 by Thomas L. Thourson under the title "Xerographic Development Processes: A Review." Herefrom can be learned that the principal dry development techniques are defined as: A. Cascade development, B. Magnetic brush development, both of which operate with a carrier-toner mixture, and C. Single component dry development, of which touchdown development is a special embodiment.

Magnetic brush development operating with conducting magnetic carrier particles permits a better solid area development than cascade development and is one of the most applied development techniques in commercial copiers. During development a magnetic brush formed by toner loaden magnetic carrier particles following magnetic field lines e.g. of magnets in a non-magnetic rotating sleeve is moved through the development zone whereby triboelectrically charged toner is transferred from the magnetically retained carrier particles onto the electrostatic charge pattern. The contact of the recording element carrying the charge image with the brush filaments of carrier particle strings loaded with toner particles is necessary to arrive at sufficient toner deposition in charged image areas that exhibit only a relatively weak coulomb attraction. The contact of said brush-like filaments formed by strings of carrier particles loaded with triboelectrically attracted toner particles has the disadvantage of spoiling high resolution work since brush marks are produced that interfere with fine image details.

The use of a development member whereon a layer of toner powder is applied for touchdown development of electrostatic charge patterns on a photoconductive recording member is described e.g. in U.S. Pat. No. 2,895,847 wherein the toner application proceeds e.g. with a camel's hair brush or the like. In the direct contact of the development member with such hair brush the formation of brush marks cannot be avoided.

In touchdown development systems, a surface bearing a layer of charged toner particles called donor element is brought in actual contact with the material carrying the charge pattern and then removed, resulting in the transfer of toner from the donor to the charged surface areas. A particular embodiment of touchdown development is described e.g. in EP-A-0 322 940.

Any of the above mentioned development techniques may be used for applying the developer composition of our invention to the photoconductive surface; the magnetic-brush development method is a preferred method. The toner particles and the spacing particles of our invention may be transferred image wise to the latent image in separate development stations or jointly in one and the same development station. In the preferred embodiment of our invention wherein the spacing particles are large toner particles, the bimodal developer mixture is image-wise transferred to the latent image bearing member in one magnetic brush development station.

Transfer of toner image

As set forth above, after the development of the latent electrostatic image the toner image should electrostatically be transferred to a toner substrate. This transfer is usually effected by placing the toner receiving substrate in contact with the developed toner image on the image bearing member e.g. a photoconductor drum, charging the substrate electrically with the same polarity as that of the latent image and then stripping the substrate from the image bearing member. The charge applied to the substrate overcomes the attraction of the latent image for the toner particles and pulls them onto the substrate.

Developer Compositions

Various kinds of toners in dry developer compositions may be used for applying the present invention. Toners suitable for use in our invention are either for use in a two-component or mono-component developer composition. The toner particles generally comprise a resin binder, a colorant, and one or more additives such as a charge control agent and a flow enhancing agent.

The spacing particles may be built up by the same ingredients as the toner particles, except the colorant. However, according to a preferred embodiment of our invention, the colorant may also be incorporated into the spacing particles. Spacing particles incorporating such colorant along with the finer toner particles together then form the so-called bimodal developer composition.

Resins

Illustrative examples of toner resins for use in accordance with the present invention include numerous known suitable resins such as polyesters, polymers of styrene/butadiene, styrene/methacrylate, styrene and acrylate, polyamides, epoxies, polyurethanes and vinyl resins. Suitable vinyl resins include homopolymers or copolymers of two or more vinyl monomers. Particularly suitable vinylic resins as well as their mode of preparation, may be found in EP-A-0380813. A particularly suitable polyester resin is ATLAC T500 (trade name of Atlas Chemical Industries Inc., Wilmington, Del. USA) being a propoxylated bisphenol A fumarate polyester, and discussed more in detail in EP-A-89 201 695.7.

Charge control agent

To enhance the chargeability in either negative or positive direction of the toner particles (a) charge control agent(s) can be added to the toner particle composition of the present invention as described e.g. in the published German patent application (DE-OS) 3,022,333 for yielding negatively chargeable toner particles or as described e.g. in the published German Patent application (DE-OS) 2,362,410 and the U.S. Pat. Nos. 4,263,389 and 4,264,702 for yielding positively chargeable toner particles. A very useful charge control agent for offering positive charge polarity is BONTRON NO4 (trade name of Oriental Chemical Industries—Japan) being a resin acid modified nigrosine dye which may be used e.g. in an amount up to 5% by weight with respect to the toner particle composition. A very useful charge control agent for offering negative charge polarity is BONTRON S36 (trade name of Oriental Chemical Industries—Japan) being a metal complex dye which may be used e.g. in an amount up to 5% by weight with respect to the toner particle composition.

Pigments

Further, the toner particles should and the spacing particles optionally may comprise a colorant, which may be a dye or pigment soluble or dispersable in the polymeric binder.

In order to obtain toner particles with sufficient optical density in the spectral absorption region of the colorant, the colorant is used preferably in an amount of at least 2% by weight with respect to the total toner composition, more preferably in an amount of 5 to 15% by weight.

For black toners preference is given to carbon black as a colorant.

Examples of carbon black and analogous forms therefore are lamp black, channel black, and furnace black e.g. SPEZIALSCHWARZ IV (trade-name of Degussa Frankfurt/M, W. Germany) and VULCAN XC 72 and CABOT REGAL 400 (trade-names of Cabot Corp. High Street 125, Boston, U.S.A.).

Toners for the production of colour images may contain organic dyes or pigments of the group of phthalocyanine dyes, quinacridone dyes, triaryl methane dyes, sulphur dyes, acridine dyes, azo dyes and fluoresceine dyes. A review of these dyes can be found in "Organic Chemistry" by Paul Karrer, Elsevier Publishing Company, Inc. New York (1950).

Also the dyestuffs described in one of the following patent applications may be incorporated into the toners of the developer composition of our invention: EP-A-0 384 040, EP-A-0 393 252, EP-A-0 400 706, EP-A-89 203 156, EP-A-89 203 157, EP-A-90 200 991, EP-A-90 203 014, EP-A-0 384 990, EP-A-0 394 563, EP-A-90 200 483.

Typical useful inorganic pigments include black iron (III) oxide, copper (II) oxide and chromium (III) oxide powder, milori blue, ultramarine cobaltblue and barium permanganate.

In order to obtain toner particles having magnetic properties a magnetic or magnetizable material may be added during the toner production. In a particular embodiment the colorant and charging additive may be one and the same compound.

Preparation of toner and spacing particles

A conventional preparation technique will be described hereinafter suitable for the production of the toner as well as the spacing particles comprised in the developer composition of the present invention.

As is said forth supra, the size and size distribution of the toner particles employed is one of the principal contributing characteristics for obtaining high fidelity in electrophotographic reproduction.

In view hereof particularly classified toner particles are preferentially used in the present invention.

Such classified toner particles may be prepared according to one of the techniques described in the patent specifications cited above, and in particular in EP-A-89 201 695.7.

The toner compositions suitable for use in accordance with the present invention should be prepared by selecting and modifying some of the known toner mixing and comminution techniques. As is generally known toner is prepared by subsequently blending and mixing the components in the molten state and after cooling, milling and micropulverizing the resulting mixture. Thereafter a suitable particle classification method is employed so as to obtain toner particles corresponding to predetermined particle-sizes, a suitable particle classification method is employed. Typical particle classification methods include air classification, screening, cyclone separation, elutriation, centrifugation and combinations thereof.

The preferred method of obtaining fine toner particles of our invention is by centrifugal air classification.

Suitable milling and air classification results may be obtained when employing a combination apparatus such as the A.F.G. (Alpine Fliessbeth-Gegenstrahlmühle) type 100 as milling means, equipped with an A.T.P. (Alpine Turboplex windsichter) type 50 G.S., as air classification means, the model being available from Alpine Process Technology Ltd., Rivington Road, Whitehouse, Industrial Estate, Runcorn, Cheshire, U.K. Further air classification can be realised using an A 100 MZR (Alpine Multiplex Labor Zickzack sichter) as additional classification apparatus, the latter model being also available from Alpine Process Technology Ltd. The size distribution of the so obtained toner particles can be determined in a conventional manner by employing a Coulter Counter type TA II/PCA1, model available from the Coulter Electronics Corp., Northwell Drive, Luton, Bedfordshire, LV 33 R4, United Kingdom.

In the air classification apparatus, air or some other gas is used as transport medium and particles contained in the fluidum are exposed to two antagonistic forces, viz., to the inwardly directed tractive force of the fluidum, and to the outwardly directed centrifugal force of the particle. For a definite size of particles, that is, the "cut size", both forces are in equilibrium. Larger i.e. heavier particles are dominated by the mass-dependent centrifugal force and the smaller i.e. lighter particles by the frictional force proportional to the particle diameter. Consequently, the larger or heavier particles fly outwards as coarse fraction, while the smaller or lighter ones are carried inwards by the air as fine fraction. The "cut size" usually depends upon the geometrical as well as operational parameters. Adjustment of the cut size may be effected through variation of the above mentioned parameters.

The parameters in operating the abovementioned apparatus should be set such that the toner particles in the dry electrophotographic developer composition of the present invention have an average particle diameter between 3 and 10 microns, still more preferably between 3 and 6 microns.

When the spacing particles used in the developer composition of our invention are produced, the operating conditions should be set such that their particle diameter is below 40 micron, as aforementioned, and their average particle diameter is at least twice the average particle diameter of the toner particles. The term 'average particle diameter' is defined hereinafter in the Examples.

Flow improving agents

By adding suitable flow improving agents, the flowability of toner particles and spacing particles prepared as described above can be sufficiently enhanced so as to obtain toner particles which are particularly suited for use in our invention.

The flow improving additives mostly are extremely fine inorganic or organic materials. Widely used in this context are fumed inorganics such as silica, alumina or zirconium oxide or titanium oxide. The use of silica as flow improving agent for toner compositions is described in the United Kingdom Patent Specification No. 1,438,110.

The fumed silica particles have a smooth, substantially spherical surface and preferably they are coated with a hydrophobic layer such as obtained by methylation. Their specific surface area is preferably in the range of 100 to 400 sq.m/g.

Fumed silica particles are commercially available under the Trade Marks AEROSIL and CAB-O-SIL marketed by Degussa, Frankfurt (M), W. Germany and Cabot Corp. Oxides Division, Boston, Mass., U.S.A. respectively. AEROSIL R972 is a fumed hydrophobic silica having a specific surface area of 110 sq.m/g. The specific surface area can be measured by a method described by Nelsen and Eggertsen in "Determination of Surface Area Adsorption Measurements by continuous Flow Method", Analytical Chemistry, Vol. 30, No. 8 (1958) 1387–1390.

The preferred proportions of fumed silica to toner material are in the range of 0.5 to 3% by weight.

In addition to fumed silica, a metal soap e.g. zinc stearate as described e.g. in the United Kingdom Patent Specification No. 1,379,252, may also be used as additional flow improving agent. Other flow improving additives are based on fluoro-containing polymer particles of sub-micron size.

The preferred proportions of metal soap such as zinc stearate to toner or spacing material are in the range of 0.05 to 1% by weight. The same holds for F-containing particles.

Particularly preferred flow improving microparticles are the fluorinated silica-type microparticles as described in EP-A-90113845.3.

In said specification a fluorinated AEROSIL is obtained by reaction between a fumed silica and $C_4F_9(CH_2)_2Si(OCH_3)_3$.

The so obtained fluorinated AEROSIL is particularly useful as flow improving additive for toners used in the application of the present invention.

Carriers

In case a two-component developer composition is used, the developer mixture comprising toner and spacing particles should be used in combination with carrier particles.

Useful carrier materials for cascade development include sodium chloride, ammonium chloride, aluminium potassium chloride, Rochelle salt, sodium nitrate, aluminium nitrate, potassium chlorate, granular zircon, granular silicon, silica, methyl methacrylate, glass. Useful carrier materials for magnetic brush development include, steel, nickel, iron, ferrites, ferromagnetic materials, e.g. magnetite, whether or not coated with a polymer skin. Other suitable carrier particles include magnetic or magnetizable materials dispersed in powder form in a binder as described e.g. in U.S. Pat. No. 4,600,675. Many of the foregoing and typical carriers are disclosed in U.S. Pat. Nos. 2,618,441; 2,638,416; 2,618,522; 3,591,503 and 3,533,835 directed to electrically conductive carrier coatings, and U.S. Pat. No. 3,526,533 directed to polymer coated carriers. Oxide coated iron powder carrier particles are described e.g. in U.S. Pat. No. 3,767,477. The U.S. Pat. Nos. 3,847,604 and 3,767,578 relate to carrier beads on the basis of nickel. An ultimate coated carrier particle diameter between about 30 microns to about 1000 microns is preferred. The carrier particles possess then sufficient inertia to avoid adherence to the electrostatic images during the cascade development process and withstand loss by centrifugal forces operating in magnetic brush development. The carrier may be employed with the toner composition in any suitable combination, generally satisfactory results have been obtained when about 1 part of toner is used with about 5 to about 200 parts by weight of carrier.

The carrier particles may be electrically conductive, insulating, magnetic or non-magnetic (for magnetic brush development they must be magnetic), as long as the carrier particles are capable of triboelectrically obtaining a charge of opposite polarity to that of the toner and spacing particles so that the toner and spacing particles adhere to and surround the carrier particles.

In developing an electrostatic image to form a positive reproduction of an original, the carrier particle composition and/or toner and/or spacing particle composition is selected so that the toner resp. spacing particles acquire a charge having a polarity opposite to that of the electrostatic latent image so that toner and spacing deposition occurs in the charged areas of the image bearing member. Alternatively, in reversal reproduction of an electrostatic latent image, the carrier particle composition and toner/spacing particle composition is selected so that the toner/spacing particles acquire a charge having the same polarity as that of the electrostatic latent image resulting in toner/spacing deposition in the non-charged areas of the image bearing member.

Our invention will now be further illustrated by means of examples.

Preparation of toner particles 90 parts of ATLAC T500 (trade name of Atlas Chemical Industries Inc., Wilmington, Del., USA) being a propoxylated bisphenol A fumarate polyester with a glass transition temperature of 51° C., a melting point in the range of 65° to 85° C., an acid number of 13.9, and an intrinsic viscosity measured at 25° C. in a mixture of phenol/ortho dichlorobenzene (60/40 by weight) of 0.175, and 10 parts of Cabot Regal 400 (trade name of Cabot Corp., Boston, Mass., USA) being a carbon black, were introduced in a kneader and heated at 120° C. to form a melt, upon which the kneading process was started. After about 30 minutes, the kneading was stopped and the mixture was allowed to cool to room temperature (20° C.). At that temperature the mixture was crushed and milled to form a powder, which was further reduced in grain size by jet milling. Then air classification of the toner particles was executed by means of a combination apparatus such as the A.F.G. (Alpine Fliessbeth-Gegenstrahlmühle) type 100 as milling means, equipped with an A.T.P. (Alpine Turboplex windsichter) type 50 G.S., as air classification means, the model being available from Alpine Process Technology Ltd., Rivington Road, Whitehouse, Industrial Estate, Runcorn, Cheshire, U.K. The size distribution of the so obtained toner particles was determined in a conventional manner by employing a Coulter Counter type TA II/PACA1, model available from the Coulter Electronics Corp., Northwell Drive, Luton, Bedfordshire, LV 33 R4, United Kingdom.

The average particle diameter by volume measured in the aforementioned Coulter Counter apparatus was 4.2 micron, and the average particle diameter by number was 3.8 micron. The average particle diameter being defined as the square root of the product of the average particle diameter by volume times the average particle diameter by number, amounted for these toner particles to 4.0 microns.

Addition of microparticles to the toner particles

The toner particles, the preparation of which is described hereinabove, were introduced in a mixing apparatus according to the procedure as described hereinafter and inorganic microparticles were admixed to the toner particles.

The microparticles were modified fumed silica as prepared by flame hydrolysis and with a specific BET-surface of 180 m2/g. The fumed silica had been modified with the following compound:

$$C_4F_9(CH_2)_2Si(OCH_3)_3$$

The method of adding the modified AEROSIL to the toner particles was as follows: 100 g of toner and 1.7 g of Aerosil were fed to a Janke and Kunkel labor-mill apparatus type IKA M20, rotating at a speed of 20,000 rpm, and thermostabilised at 20° C. (model available from the Janke and Kunkel GmbH, IKA Labortechnik, D-7813 Staufen, W. Germany). Mixing time: 15 sec.

Preparation of spacing particles A

Spacing particles were prepared according to the same procedure as described above for the preparation of the toner particles, with the following differences however. The crushing, jet milling and air classification operations were performed with the same apparatus as described above; however the operating conditions were set in such a way that the resulting spacing particles were characterised, as measured in the Coulter Counter apparatus, by an average particle diameter by volume of 12.2 micron, by an average particle diameter by number of 10.9 micron, and by an average particle diameter as defined above, of 11.6 micron.

The ratio of the average particle diameter of the so prepared spacing particles over the average particle diameter of the toner particles, the preparation of which is described above, thus amounted to 2.75.

So as to obtain an easily, freely flowing powder of such spacing particles, microparticles as described above were added to said spacing particles composition in an amount of 0.6% by weight.

Preparation of spacing particles B

Spacing particles were prepared according to the same procedure as described hereinbefore with the difference however that the operating conditions of the jet milling and air classification operations were so set that, as measured in a Coulter Coulter apparatus, the spacing particles were characterised by an average particle diameter by volume of 17.5 micron, by an average particle diameter by number of 15.4 micron and an average particle diameter as defined above of 16.4 micron.

The ratio of the average particle diameter of the so prepared spacing particles over the average particle diameter of the toner particles, the preparation of which is described above, thus amounted to 4.15.

So as to obtain an easily, freely flowing powder of such spacing particles, microparticles as described above were added to said spacing particles in an amount of 0.4% by weight.

EXAMPLE 1 (comparative)

A developer composition for use in a two-component electrophotographic process was prepared as follows: after addition of the toner particles prepared according to the procedure set forth above to an ordinary Zn-Ni-ferrite carrier (with an average particle diameter of 75 microns) in an amount of 4 parts by weight to 100 parts by weight of carrier, the developer was activated by rolling in a metal box with a diameter of 6 cm, at 300 revolutions per minute, during a period of 30 minutes, with an apparant degree of filling of 30%.

EXAMPLE 2

A developer composition for use in a two-component electrophotographic process was prepared as follows: a mixture comprising 97 parts by weight of the toner particles prepared according to the procedure set forth above and 3 parts by weight of the spacing particles A prepared according to the procedure set forth above was added to an ordinary Zn-Ni-ferrite carrier according to the same weight ratio as set forth under Example 1, namely 4 parts by weight of the mixture of toner and spacing particles and 100 parts by weight of Zn-Ni-ferrite carrier. The developer was then activated according to the same procedure as set forth above under Example 1.

EXAMPLE 3

The procedure for preparing the developer composition as described under example 2 was repeated with the difference however that a mixture comprising 94 parts by weight of toner particles and 6 parts by weight of spacing particles A was used.

EXAMPLE 4

The procedure for preparing the developer composition as described under example 2 was repeated with the difference however that a mixture comprising 91 parts by weight of toner particles and 9 parts by weight of spacing particles A was used.

EXAMPLE 5

The procedure for preparing the developer composition as described under example 2 was repeated with the difference however that a mixture comprising 99 parts by weight of toner particles and 1 part by weight of spacing particles A was used.

EXAMPLE 6

The procedure for preparing the developer composition as described under example 2 was repeated with the difference however that a mixture comprising 99.5 parts by weight of toner particles and 0.5 parts by weight of spacing toner particles A was used.

EXAMPLES 7, 8, 9

The procedure for preparing the developer compositions as described under Examples 4, 5 and 6 was repeated with the difference however that instead of the spacing particles prepared according to procedure A, spacing toner particles prepared according to procedure B were used.

For sake of convenience, the essential characteristics of the developer compositions of the Examples described above are summarized in the following table I.

TABLE I

| Example No. | Type of spacing particles | weight percent toner particles | weight percent spacing particles |
|---|---|---|---|
| 1 (compar.) | — | 100 | — |
| 2 | A | 97 | 3 |
| 3 | A | 94 | 6 |
| 4 | A | 91 | 9 |
| 5 | A | 99 | 1 |
| 6 | A | 99.5 | 0.5 |
| 7 | B | 91 | 9 |
| 8 | B | 99 | 1 |
| 9 | B | 99.5 | 0.5 |

Use of the developer compositions of the examples 1 to 9 in an electrophotographic process.

Development and transfer

An electrostatic image formed on an electrophotographic recording element, i.e. an $As_2Se_3$ coated photoconductive drum, which was positively charged by means of a corona-grid discharge and imagewise exposed in an optical scanning apparatus with a moving original and a fixed 305 mm lens, was developed by a magnetic brush using the developer compositions of the above examples.

The transfer of the electrostatically deposited toner and spacing particles of any of the above Examples proceeded by applying a positive voltage of 7 kV to a DC transfer corona, which was kept in close contact with the rear side of a receiving substrate being a paper type 'couché' 120 g/m2 available from Arjomari S. A., impasse Reille 1, 75014 Paris, whose front side was therefore kept in close contact with the toner/spacing image on the photoconductor. An AC corona discharge was applied to the back of the receiving substrate immediately following the application of the DC transfer corona to facilitate removing the receiving substrate with the transferred toner image from the photoconductor surface.

Fixation

The toner imaged substrate was fed to a fusing device operating with an infrared radiator provided with a reflective coating. At the rear side of the receiving substrate a heating plate was provided. The infrared radiator was located at a distance of 10 mm from the toner imaged substrate surface which was caused to move past the radiator at a rate of 5 cm/s.

The heating plate was brought to a temperature of 125° C. A power of 550 W was applied to the infrared radiator corresponding to a temperature of about 2600K. The plate was irradiated for about ½ to 1 second.

Evaluation of transfer efficiency and subsequent copy quality

The experimental results with respect to the efficiency of the transfer of the toner image on the photoconductor to the toner receiving substrate, for the developer compositions of the examples 1 to 9, and with respect to the quality of the final copy obtained, were as follows.

When the developer composition of Example 1 was used, an overall high resolution image quality was obtained thanks to the overall small size distribution of the toner particles used; however the image defects caused by a deficient, poor transfer of toner particles from the photoconductive surface to the receiver cited above such as the appearance of 'hollow characters', vibrated image parts, uneveness in density etc. were noted. These defects adversely affected the overall image quality. After running 1000 copies, fresh toner being regularly fed to the developer composition as a compensation for exhaustion of toner during the copying process in accordance with the toner concentration control method described in EP-A-0 140 996, the image defects described above were invariably noted.

When the developer composition of Example 2 was used however, an overall high resolution image quality without the defects described above was obtained. After running 1000 copies, feeding the toner/spacing particles mixture as defined under Example 2 according to the method of EP-A-0 140 996, no quality degradation was noted. An adverse effect of the larger toner spacing particles on the overall image quality was not noticed; after passage in the fusing station these larger particles were also fused and faded in the overall toned image.

When the developer composition of Example 3 was used, nearly identical results as those described when using the developer composition of Example 2 were obtained.

When the developer composition of Example 4 was used simular results were obtained as when the developer compositions of the Examples 2 and 3 were used. However an onset for quality defects such as irregular straight lines, unsharp edges of letters, loss in resolution etc. was noted. As a conclusion, a concentration of 9 percent spacing particles in the overall developer composition can not be exceeded.

When the developer compositions of the Examples 5 and 6 were used simular results were obtained as when the developer composition of the Examples 2 and 3 were used. However when a run of 1000 copies was produced in example 5 and especially in example 6, at irregular intervals the image defects described supra when the developer composition of example 1 was used, were also noted. The cause hereof is that the concentration of large spacing particles in the overall developer composition became too low. When this low amount of spacing particles as described in example 6 was used in the development of latent images on the photoconductive drum, then the above described image defects reappeared when approx. 100 copies had been produced. This deterioration in image quality is probably caused by the fact that a so low concentration of spacing particles can hardly be kept constant in a steady state copying operation using a conventional toner replenishment system, such as the one cited above.

As a conclusion it appears that 1 to 2% of spacing particles in the overall developer composition is a minimum requirement for steady state operation.

When the developer compositions of the Examples 7, 8 and 9 were used, the experimental results set forth above were confirmed.

We claim:

1. A high resolution electrostatographic method comprising the steps of:

i. providing an electrostatic latent image on an image bearing member;

ii. developing said electrostatic latent image with a developer composition, comprising dry toner particles with an average diameter between 3 and 10 μm, to have a developed image;

iii. electrostatically transferring said developed image to a substrate on a transfer roller, wherein the space between said image bearing member and said substrate on a transfer roller is kept constant by said developer composition further comprising dry spacing particles, the average particle diameter whereof is between 10 and 40 μm and being at least twice the average particle diameter of said toner particles, said spacing particles being present in an amount between 1 and 8% by weight based on the overall amount of spacing particles and toner particles.

2. An electrostatographic method according to claim 1, wherein the part of spacing particles in the overall amount of spacing particles and toner particles is comprised between 2 and 5% by weight.

3. An electrostatographic method according to claim 1, wherein the average diameter of said toner particles is between 3 and 6 μm.

4. An electrostatographic method according to claim 3, wherein the average particle diameter of the spacing particles is between 10 and 20 μm.

5. An electrostatographic method according to claim 1, wherein the chemical composition of said spacing particles differs from the chemical composition of said toner particles.

6. An electrostatographic method according to claim 1, wherein the composition of said spacing particles and the composition of said toner particles are of the same chemical composition.

* * * * *